US005308071A

United States Patent [19]

Lewis

[11] Patent Number: 5,308,071

[45] Date of Patent: May 3, 1994

[54] APPARATUS FOR IMPROVING A GOLFER'S PUTTING STROKE

[76] Inventor: John F. Lewis, P.O. Box 363, Hudson Heights, Quebec, Canada, J0P 1J0

[21] Appl. No.: 987,630

[22] Filed: Dec. 9, 1992

[51] Int. Cl.[5] ..... A63B 69/36

[52] U.S. Cl. ..... 273/187.2; 273/186.2; 273/192; 273/194 R

[58] Field of Search ..... 273/187.2, 186.2, 188 R, 273/189 R, 192, 144 R, 193 R, 191 A, 191 R, 81 D, 163 R, 163 A, 166

[56] References Cited

U.S. PATENT DOCUMENTS

| | | | |
|---|---|---|---|
| 1,561,349 | 11/1925 | Murphy et al. | 273/81.3 |
| 1,616,377 | 2/1927 | Knight . | |
| 1,618,638 | 2/1927 | Coles . | |
| 1,684,192 | 9/1928 | Nemeth | 273/188 |
| 2,132,219 | 10/1938 | Pirie | 273/81 |
| 2,706,635 | 4/1955 | Thomas | 273/192 |
| 3,170,690 | 2/1965 | Goranson et al. | 273/77 |
| 3,188,086 | 6/1965 | Parmley | 273/81.3 |
| 3,245,686 | 4/1966 | Hartmeister | 273/81.3 |
| 3,532,344 | 10/1970 | Malltab | 273/187.2 |
| 4,133,535 | 1/1979 | Marsh | 273/194 R |
| 4,479,653 | 10/1984 | Woodson | 273/187.2 |
| 4,491,323 | 1/1985 | Kozub | 273/81 D |
| 4,582,325 | 4/1986 | Yahara | 273/187.2 |
| 4,669,726 | 6/1987 | Lempio | 373/165 |
| 4,880,240 | 11/1989 | Lewis | 273/188 R |
| 4,919,433 | 4/1990 | Mylat | 273/192 |
| 5,026,066 | 6/1991 | Kane | 273/192 |
| 5,102,142 | 4/1992 | Bittl | 273/187.2 |

FOREIGN PATENT DOCUMENTS

| | | | |
|---|---|---|---|
| 522814 | of 0000 | United Kingdom . | |
| 165960 | 7/1921 | United Kingdom | 273/187.2 |

*Primary Examiner*—Mark S. Graham

*Attorney, Agent, or Firm*—Pearne, Gordon, McCoy & Granger

[57] ABSTRACT

A simple, reliable and effective apparatus for assisting a golfer in improving their putting stroke is disclosed. The apparatus includes a guide attachable to the waist of the golfer and an extension attachable to the putter grip. The guide includes a narrow slot which is horizontally oriented when the guide is attached to the waist of the golfer. The extension includes a top end which terminates in a thin, wide guide member which slides in the slot of the guide. The extension is preferably a longitudinal section of a cylinder which will clip over the putter grip. The putter grip is preferably covered with the loop portion of a hook and loop fastener. A strip of hook fastener is bonded to the extension so that the hooks engage the loops when the grip of the putter is forced into the bight of the extension. This provides a strong effective attachment. The advantage of the apparatus is that it provides a reliable guide which permits the user to relax and learn the motions required for an ideal putting stroke. The same principle of attachment can also be used to provide an extension for use with a normal length putter in pendulum stroke putting.

16 Claims, 5 Drawing Sheets

APPARATUS FOR IMPROVING A GOLFER'S PUTTING STROKE

FIELD OF THE INVENTION

The present invention relates to golfing equipment and, in particular, to a novel apparatus for improving a golfer's putting stroke.

BACKGROUND OF THE INVENTION

Golfing is a popular sport which is now played throughout the world. Putting has been recognized as one of the most difficult aspects of the game and accounts for nearly half of a golfer's score. It is generally recognized that putting causes more anxiety among golfers than any other aspect of the game. While most approach shots offer an opportunity of recovery, every missed putt adds a stroke to the score and no amount of skillful follow up can change that. The following statistics collected from PGA tour professional scores during tournament play indicate the difficulty which putting poses:

| Length of Putt | Successful Putts |
|---|---|
| 6 feet | 45-55% |
| 10 feet | 15-30% |
| 15 feet | 10-22% |
| 20 feet | 6-16% |
| 25+ feet | 10% |

For putts over 25 feet, the percentage of success declines as the length of the putt increases.

When professionals who practice constantly have so little success at putting, it is no wonder that ordinary golfers often consider putting a frustrating exercise. The following patents are known to relate to various inventions directed to improving golfers' performance:

U.S. Pat. No. 3,188,086—Parmley
U.S. Pat. No. 3,170,690—Goranson et al
U.S. Pat. No. 2,132,219—Pirie
U.S. Pat. No. 1,616,377—Knight
U.S. Pat. No. 1,561,349—Murphy et al
U.S. Pat. No. 1,618,638—Coles
U.S. Pat. No. 1,684,192—Nemeth
U.S. Pat. No. 2,706,635—Thomas
U.S. Pat. No. 4,491,323—Kozub
G.B. 522,814—Cottingham The applicant's U.S. Pat. No. 4,880,240 which issued Nov. 14, 1989 also relates to an apparatus for improving a golfer's putting stroke. While this apparatus represents an advance in the art, subsequent experimentation and experience has shown that the apparatus can be further improved.

It is a well known principle that the shaft length of a putter should enable a golfer's arms to hang comfortably when their eyes are directly over the ball. If the putter is too short, the golfer will stand too close to the ball and their eyes will be outside a target line which lies under the center of the ball. If the putter shaft is too long, it forces the golfer away from the ball and their eyes are inside the target line.

There are three principal factors which affect the mechanics of putting. Those factors include:

1) Putter Path. The proper path for the putter is a straight back and straight forward stroke along the target line. Any deviation from the target line at the impact zone will transmit into a deviation in the roll of the ball. On a 10' (3.3 m) putt, striking the ball with a putter moving five degrees off line results in missing the cup by 2" (5 cm). Although most beginners cannot detect five degrees of misalignment at the impact zone, the results are noticeably detectable.

2) Face Angle. When a putter impacts a golf ball, the face of the putter must be at right angles to the target line. If the face of the putter is not square to the target line, 90% of the deviation is translated into a deviation in the roll of the ball. For a 10' (3.3 m)putt, if the face of the putter is skewed by five degrees, the ball will miss the hole by about 9" (22.5 cm).

3) Impact Point. For every putter, there is an ideal point of impact on the face of the putter. This point is commonly referred to as the "sweet spot". If a stroke misses the "sweet spot" by a quarter of an inch (0.6 cm), 95% of the error is transferred to the movement of the ball. That error translation is enough to cause the ball to miss the cup on any putt which is more than 8' (2.6 m) in length. The farther away from the impact zone that the ball is struck, the more deviation is translated to the path of the ball.

Most golfers, especially beginning golfers, find it difficult if not impossible to coordinate the putter path, the face angle, and the impact point while attempting to judge the required force to sink a putt. As a result, many golfers find putting a frustrating and unsatisfying activity which is never fully mastered. There therefore exists a need for a simple apparatus which permits a golfer to concentrate on the best target line and the speed of a green while his or her body "learns" the muscle movements required to control putter path, face angle and impact point.

A recent development in golf putting is the use of extra long putters (up to 52" (132 cm)) in a technique known as the "pendulum stroke". The pendulum stroke involves gripping the top of a long putter shaft in one hand steadied against the chest and swinging the putter in a pendulum action with the other hand. This is believed to lessen the control required of the short muscles in the wrists and hands for a traditional putting stroke.

One problem with extra long putters is that they do not fit properly into a golf bag. Such putters are therefore difficult to handle when not in play. Telescoping putter shafts have been developed to overcome this problem but telescoping shafts are expensive to manufacture and unstable if not well made. There therefore exists a need for an inexpensive removable extension for use with a putter of normal length which permits the putter to be used for pendulum stroke putting.

SUMMARY OF THE INVENTION

It is an object of the invention to provide an apparatus for improving a golfer's putting stroke which overcomes the disadvantages of the prior art.

It is a further object of the invention to provide an apparatus for improving a golfer's putting stroke which permits the golfer to address the ball in a natural and relaxed stance so that a proper putting motion is learned by repetition.

It is a further object of the invention to provide an apparatus for improving a golfer's putting stroke which is simple and inexpensive to manufacture.

It is yet a further object of the invention to provide an apparatus for improving a golfer's putting stroke having a component which is readily attached to the grip of a putter having a shaft of an appropriate, standard length.

It is another object of the invention to provide an apparatus for improving a golfer's putting stroke which can be used in conjunction with the putter normally used in regular play by the golfer.

It is yet another object of the invention to provide an extension for the shaft of a golf putter which permits a golfer to use a normal length putter for pendulum stroke putting.

There is therefore provided in accordance with a first aspect of the invention an apparatus for assisting a golfer while putting comprising, in combination, an extension attachable to a grip of a golf putter, the extension extending beyond a top end of the grip when attached thereto in a predetermined location and orientation and having a free end which terminates in a guide member with opposed guide surfaces, at least one of the guide surfaces being planar, the planar surface being aligned at right angles to a face of the putter when the extension is attached to the grip in the predetermined orientation; and, a guide means for attachment to the waist of the golfer, the guide means including a slot for slidably accommodating the guide member to direct the putting stroke in a predetermined plane.

In one aspect the invention therefore comprises an extension which is attachable to the grip of a standard putter. In accordance with the preferred embodiment, the extension comprises a longitudinal section of a circular cylinder which fits snugly around a part of the perimeter of a putter grip covered with the loop portion of a hook and loop fastener. A strip of hook fastener adhesively affixed to a bight of the extension securely attaches the extension to the putter when the grip is forced into the bight. A top end of the extension terminates in a flat guide member which rides in a slot in a guide means attachable to the waist of the golfer. This apparatus has many advantages over the prior art. First, it can be used with a putter which the golfer normally uses in regular play. The loop fastener attached to the grip of the putter provides a soft and comfortable grip which, if anything, improves the feel of most putter grips. When the golfer wishes to practice a putting stroke, he/she can attach the extension to the putter grip and the guide means to a belt or pants top in a matter of seconds. In use, the guide member rides in the slot in the guide means. If the extension is attached to the putter grip in a proper orientation, the apparatus controls the putter path, the face angle and contributes significantly to controlling the impact point of the putter with the ball. This permits a golfer to concentrate on selecting a target line and a putting force. Since the guide member rides in a slot, no concentration on the part of the golfer is required to maintain the putter grip in a correct position. This allows the muscles of the shoulders, arms and wrists to relax and follow through the putting stroke in a natural manner, permitting the muscles to "learn" a proper putting stroke without mental concentration on those movements.

The extension may be placed on either the front or back side of the putter grip, permitting the user to make subtle adjustments to the geometry of the stroke and thereby optimize their putting practice.

The guide means attachable to the waist of the golfer is preferably a tubular section having a longitudinal slot cut on one side and clips formed in the opposite side so that the guide may be hooked to a belt or a pant top. The guide means may, of course, be constructed as an integral part of a belt or the like, if preferred. In accordance with the preferred embodiment, a rear side of the guide means is cut away between the clips so that the rear side conforms to the shape of the waist of the golfer.

In accordance with a further aspect of the invention there is provided an extension for extending the length of a normal putter so the putter can be used for pendulum stroke putting. The extension preferably includes a bottom end which comprises a longitudinal section of a circular cylinder that forms a bight that fits snugly around a part of the perimeter of a putter grip. The putter grip is at least partially covered with a loop portion of a hook and loop fastener. An interior of the bight includes a hook portion of the hook and loop fastener for engaging the loop portion when the putter grip is forced into the bight. A top end of the extension may terminate in any shape that is comfortable to grip, such as a cylindrical grip, a ball-shaped grip or the like. The extension is readily removed from the putter shaft and stored in a golf bag when not in use, providing an inexpensive solution to the problem of providing an extra long putter which may be accommodated in a golf bag and easily handled when not in use.

BRIEF DESCRIPTION OF THE DRAWINGS

The invention will now be more fully explained by way of example only and with reference to the following drawings wherein.

DETAILED DESCRIPTION OF THE PREFERRED EMBODIMENT

Figure 1:
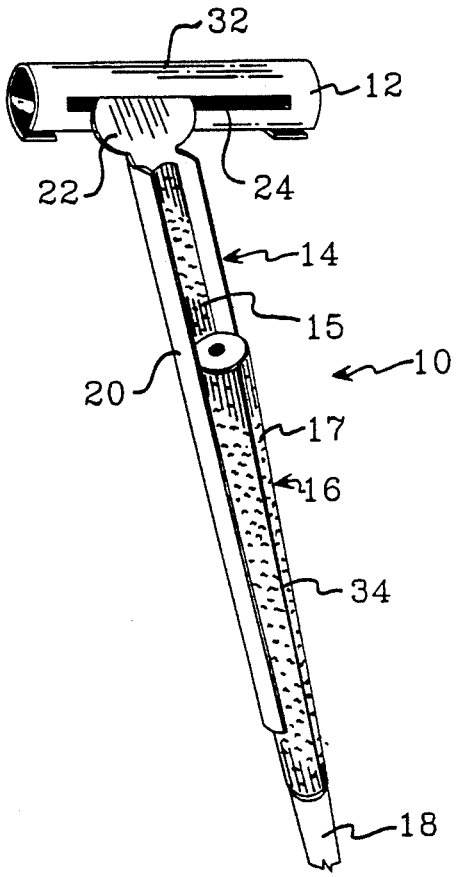
FIG. 1 is a perspective view of a top end of a golf putter equipped with an extension and guide in accordance with the invention.

FIG. 1 shows an apparatus for improving a golfer's putting stroke in accordance with the invention, which is generally referred to by the reference 10. The apparatus includes a guide 12 which is attachable to the waist of a golfer and a putter extension 14 which is attachable to the grip 16 of a putter shaft 18. The putter extension 14 includes a semi-cylindrical portion 20 for engaging the putter grip 16 and a guide member 22 having opposed guide surfaces. The guide member 22 rides in a guide slot 24 in the guide 12. The guide member 22 preferably fits slidably in the guide slot 24 with a minimum of play. The guide slot 24 is preferably cut at an angle so that the guide member 22 slides freely back and forth in the guide slot 24 when the putter is positioned for a putting stroke.

The putter extension 14 is preferably attached to the putter grip 16 by a hook and loop fastener. The putter grip 16 is preferably covered with a loop fastener material 15, commonly available in long adhesive-backed strips which may be wound in a spiral pattern around the putter grip. Sheets of the loop material can also be used for this purpose. The loop fastener material 15 provides a comfortable grip and does not interfere with normal use of the putter. It is also available in a variety of attractive colors so that it is not aesthetically unpleasant. Alternatively, only the front and back portions, or a preferred one of the front or back side of the putter shaft need be covered with loop fastener 15. A golfer may retrofit a putter to be used with the putter extension 14 and the guide 12, and continue to use the putter during normal play. A kit which includes all the required components may be supplied for this purpose.

A strip of hook fastener 17 adhesively attached to the bottom of a bight formed by the sides of the extension 14 connects with the loop fastener 15 when the putter grip 16 is forced into the bight. The resulting attachment is surprisingly rigid. There is no tendency for the putter extension 14 to separate from the putter grip 15 and there is no detectable wobble between the two. Other methods of attaching the extension 14 may be used but the method described above is believed to be best.

The extension 14 is most economically made from a tubular section such as a rigid thermoplastic pipe. A section of pipe is cut longitudinally to the taper of a putter grip. The opposed side edges of the extension 14 preferably extend past a diameter of the putter grip so that the side edges exert a clamping pressure on the putter grip 16 when it is pushed into the bight of the extension 14.

Figure 2:
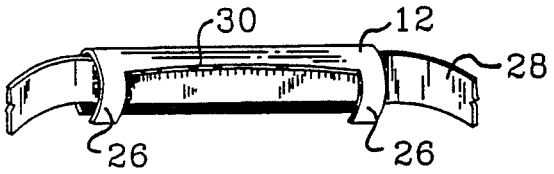
FIG. 2 is a rear view of the guide shown in FIG. 1.

FIG. 2 shows a rear perspective view of the guide 12. The guide is preferably and conveniently constructed from rigid plastic tubing commonly made from extrudable thermoplastics such as PVC and the like. The shape of the guide 12, per se, is unimportant so long as the guide is attachable to the waist of a golfer or affixed to a belt or the like so it may be attached to the waist of a golfer and the guide defines a slot which is oriented in a horizontal orientation when attached to the waist of the golfer. As shown in FIG. 2, the guide is most economically made by machining the ends of a tube to form a pair of clips 26 which can be clipped over a belt 28 or a pant top (not illustrated) or the like. In order to facilitate attaching the guide 12 to the belt 28 and to make the guide more comfortable to wear, a region of the guide 12 between the clips 26 is cut away in an arched contour 30 to conform to the waist of the golfer.

Figure 3:
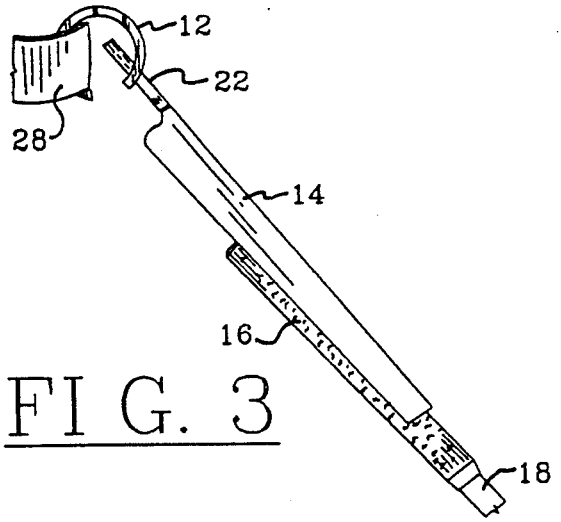
FIG. 3 is a side elevational view of the guide member of the extension in accordance with the invention engaged in the slot in the guide, with the extension attached to a front side of a putter grip.

FIG. 3 shows a side elevational view of the putter extension 14 engaging guide 12 when the putter extension 14 is attached to a front side putter grip.

Figure 4:
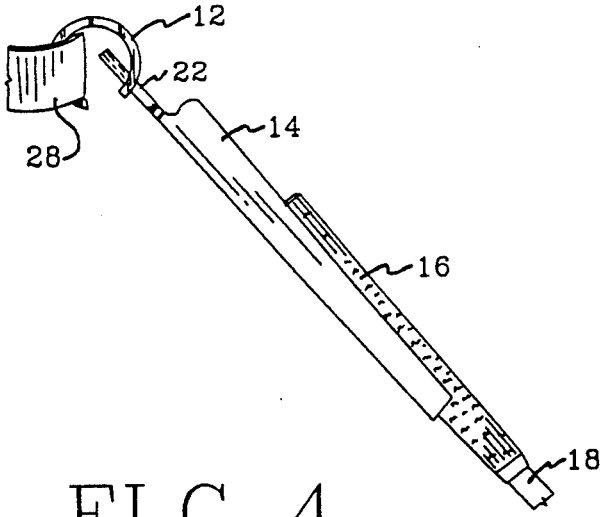
FIG. 4 is a side elevational view of the guide member engaging the guide shown in FIG. 3 with the extension attached to a rear side of the putter.

FIG. 4 shows the putter extension 14 engaging the guide 12 when the putter extension is attached to a rear side of the putter grip. This reversible attachment provides a means of subtly adjusting the angle of the putter shaft in relation to the waist of the golfer in order to accommodate different putter geometries and different physiologies. The apparatus in accordance with the invention is therefore flexible enough to accommodate practically any putter and practically any user.

Figure 5:
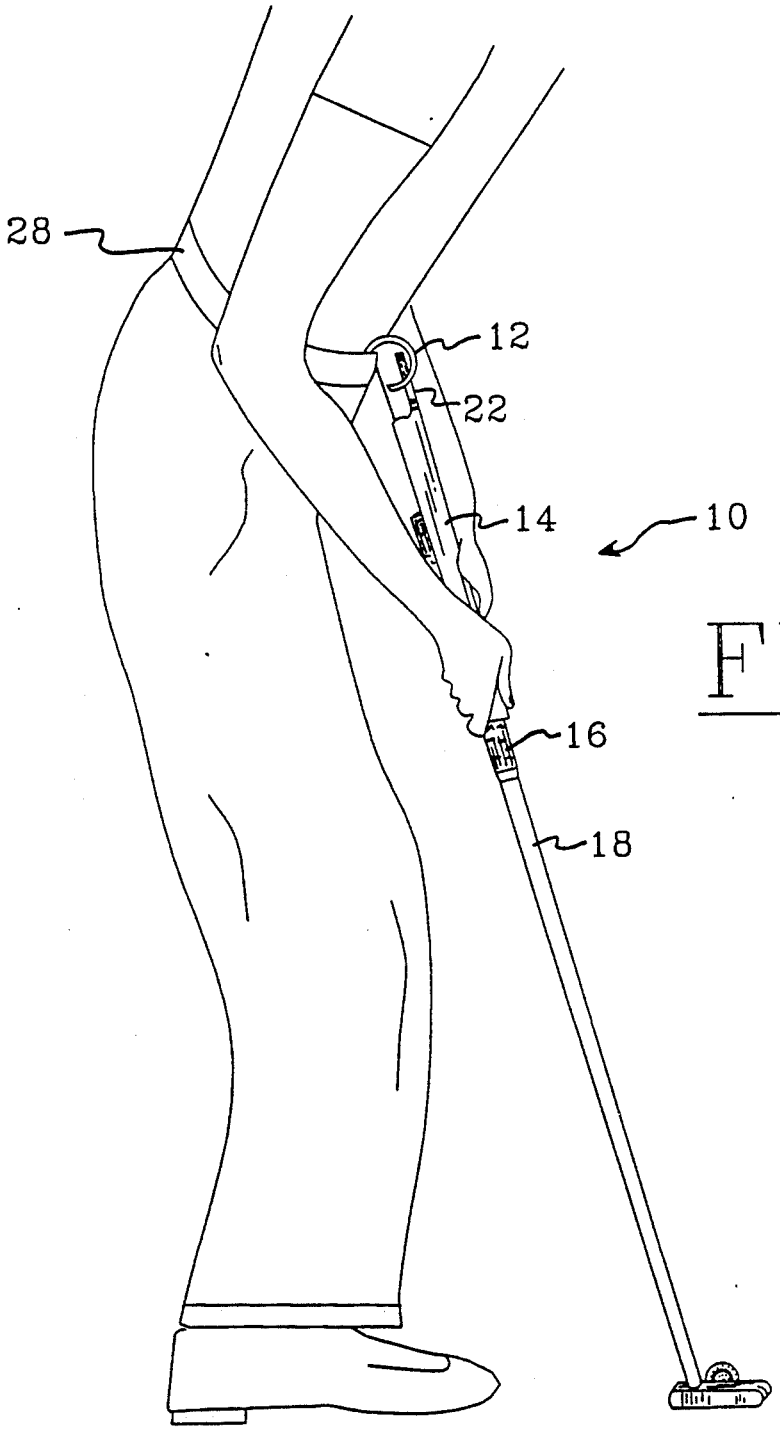
FIG. 5 is a perspective view of a golfer shown in phantom lines using the apparatus in accordance with the invention as a putting guide.

FIG. 5 shows a golfer using the apparatus in accordance with the invention. In use, the guide 12 is clipped to the belt or the pant top of the user and the extension 14 is clipped to a front or a rear of the putter grip in alignment with alignment marks 34 (see FIG. 1) on the putter shaft. The guide member is then pressed against a top surface 32 of the guide 12 and slid downwards. With this movement, the guide member 22 slides into slot 24 without necessity of focusing attention on the guide 12 or guide member 22. The guide member 22 "locks" into place automatically. If a putter is carefully selected to have the proper length of shaft for the height of the golfer and the extension is properly affixed to the putter grip, the golfer is automatically directed to a proper stance with respect to the distance from the ball due to the geometry enforced by engagement of the guide member 22 in the guide slot 24.

A proper initial setup of the apparatus is achieved by adjusting the position of the extension 14 on the putter grip 16 until the sweet spot on the putter is aligned with the center of the ball when the golfer holds the putter grip 16 in a relaxed arms-extended position with the eyes directly over the ball. Once this initial setup has been achieved, the position of the extension on the putter grip is preferably marked with an indilable marker, or the like, so that the extension 14 may be replaced in the same position of the putter each time practice putts are made. The flat surfaces of the guide 22 maintain a face of the putter at right angles to the path of travel when the extension 14 is affixed in proper alignment on the putter shaft. This alignment is aided by alignment marks 34 which preferably extend a full length of each side of the putter grip. The alignment marks 34 are aligned with a corresponding alignment mark (not illustrated) on a center of the bottom end of the extension 14.

When using the apparatus in accordance with the invention, the golfer is therefore directed immediately to a stance which is properly distanced from the ball, and the putter is automatically aligned along a proper direction of travel with respect to a position of the golfer's body. Because the guide member 22 engages the guide slot 24, the golfer can relax the muscles in the shoulders, arms and wrists and follow through the putting motion in a relaxed state without holding a guide in contact with a guide surface. This permits the golfer to concentrate on determining an optimum path of travel and an optimum putting force. The muscles of the arms and wrists automatically learn the movements required to move the putter along an optimum stroke and the eyes are trained to recognize a proper alignment of the putter face so that the ball contacts the sweet spot. After practicing with this apparatus, the guide 12 is removed from the belt and the extension 14 is removed from the putter. The same putter may therefore be used for normal play as well as practice. Since the extension 14 is practically weightless and does not contribute any significant increase in the diameter of the shaft 16, the putter has substantially the same weight and feel as it has during practice. There is therefore a comfortable, natural transition from the practice green to the playing green and the muscles of the shoulders, arms and wrists are able to utilize the motions learned during practice to more successfully sink putts.

Figure 6:
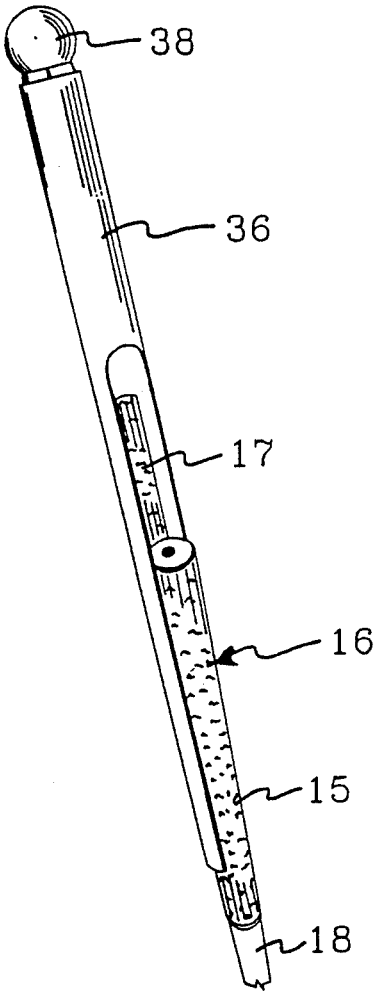
FIG. 6 is a perspective view of an extension in accordance with a second aspect of the invention attached to the grip of a putter shaft to permit the putter to be used for pendulum stroke putting.

FIG. 6 shows an extension for a golf putter shaft in accordance with a further aspect of the invention. The extension 36 is useful for extending the length of a normal putter so that it may be used in pendulum stroke putting. The extension 36 is preferably tubular. A bottom end of the extension 36 is shaped in accordance with the principle described above wherein a bight is formed for receiving a grip of the putter shaft. A strip of the hook component 17 of a hook and loop fastener is adhesively affixed to a bottom of the bight. The putter shaft 16 is covered, or partially covered, with a loop component 15 of the hook and loop fastener as described above with reference to FIG. 1. The top end 38 of the putter extension 36 is preferably shaped to provide a comfortable grip for the pendulum stroke. The top end 38 may therefore be ball-shaped, as illustrated, cylindrical (not shown) or any other convenient or popular shape.

Figure 7:
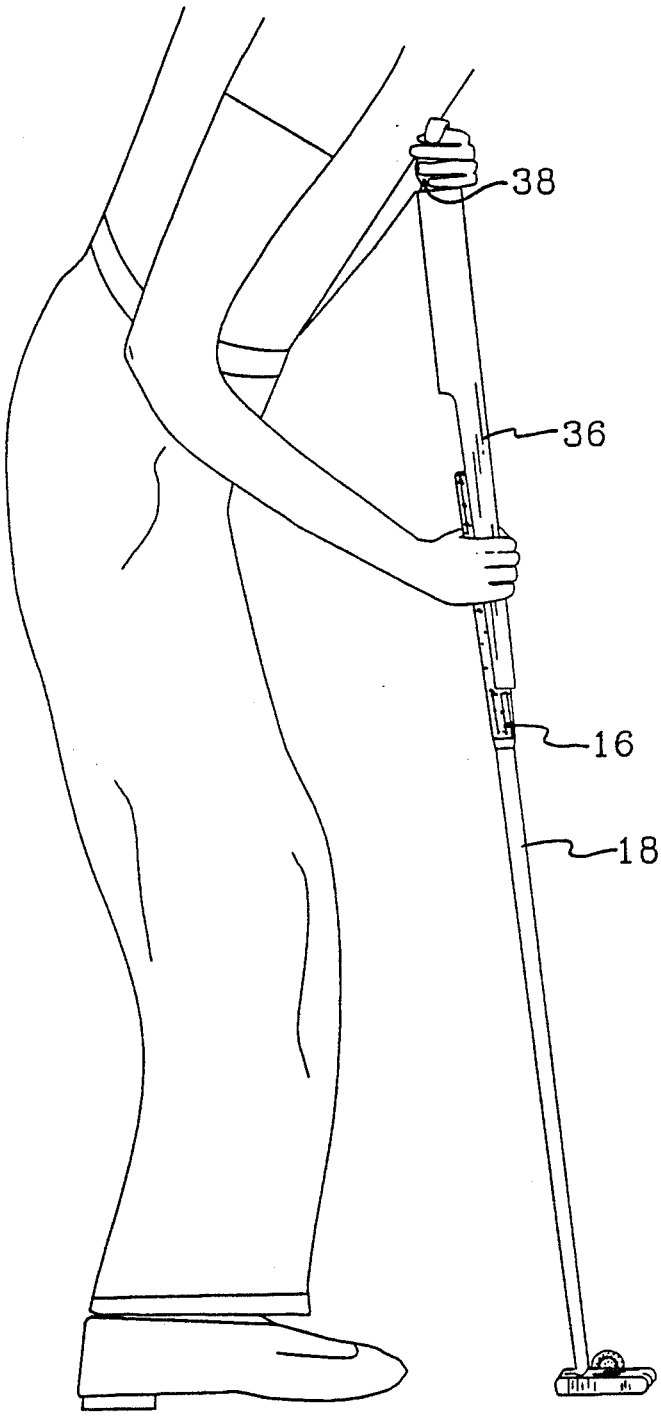
FIG. 7 is a perspective view of a golfer shown in phantom lines using the extension shown in FIG. 6 for pendulum stroke putting.

FIG. 7 shows a golfer using a putter of normal length with the extension shown in FIG. 6 attached to the grip of the putter shaft to extend its length. The golfer is putting using the pendulum stroke, which is accomplished by gripping the top end 38 of the extension 36 in one hand and steadying that hand against the chest. The other hand grips the putter grip 16 and the putter is swung around a pivot point located at the top end 38 of the extension 36 in a pendulum action. This putting style is preferred by some golfers because it is believed to offer better control of the putter path and the face angle.

The advantage of the extension 36 is that it is inexpensively manufactured yet provides a strong and reliable extension which is readily removed when not in use. This permits the use of a putter of normal length for pendulum stroke putting. The extension 38 may be stored in a golf bag when not in use, eliminating the awkwardness of handling a putter with an extra long shaft.

INDUSTRIAL APPLICABILITY

The apparatus described above in accordance with a first aspect of the invention provides a practical means of assisting a golfer in improving their putting stroke. The apparatus is readily manufactured and has an extended service life without maintenance or repair. The apparatus provides a valuable practice facilitator because it automatically controls several variables which must be learned for a successful putting stroke without interfering with a relaxed and natural approach to putting. The apparatus is adapted to use with substantially any normal well-fitted putter. It may be marketed in a kit form which is complete with a putter, the preferred presentation because alignment marks 34 (see FIG. 1) can be placed with precision. It may also be marketed in a kit form which does not include a putter with instructions for locating the alignment marks 34. The apparatus therefore offers a significant contribution to golfers who wish to improve the most difficult aspect of their golf game.

In accordance with the further aspect of the invention, the same principles for attaching an extension to the grip of a golf putter are employed to provide an extension that permits a normal length putter to be used for pendulum stroke putting. This permits golfers equipped with a putter of normal length to experiment with the pendulum stroke without investing in an expensive putter with an extra long shaft. It also permits those who prefer the pendulum stroke to play with a normal length putter that is equipped with the extension, the advantage being that when the extension is removed the putter fits neatly in a golf bag.

Those skilled in the art will readily understand that changes and modifications may be made to the specific embodiments described above.

The embodiments described are intended to be exemplary only, the scope of the invention being limited solely by the scope of the appended claims.

I claim:

1. Apparatus for assisting a golfer while putting comprising, in combination:

an extension adapted to be attached to a grip of a gulf putter, the extension extending beyond a top end of the grip when attached thereto in a predetermined orientation and having a free end which terminates in a guide member with opposed guide surfaces, at least one of the guide surfaces being planar, the planar surface being aligned at right angles to a face of the putter when the extension is attached to the grip in the predetermined orientation; and a guide means with means for attachment to a waist of the golfer, the guide means including a slot for slidably accommodating the guide member to direct the putting stroke in a predetermined plane.

2. The apparatus for assisting a golfer while putting as claimed in claim 1 wherein the extension is attachable to the grip of the putter with a hook and loop fastener means.

3. The apparatus for assisting a golfer as claimed in claim 2 wherein a hook fastener of said hook and loop fastener means is attached to the extension for attachment to a loop fastener of said hook and loop fastener means which is adhesively affixed to the grip of the putter.

4. The apparatus for assisting a golfer as claimed in claim 3 wherein the extension comprises a longitudinal section of a circular cylinder and the guide member comprises a terminal portion of the free end of the extension which is flattened to a planar configuration.

5. The apparatus for assisting a golfer as claimed in claim 4 wherein the extension comprises a tubular section.

6. The apparatus for assisting a golfer as claimed in claim 1 wherein the guide means comprises a circular cylinder having a longitudinal slot located on a first side and means for attaching the guide means to the waist of the golfer associated with the other side.

7. The apparatus for assisting a golfer as claimed in claim 6 wherein the means for attaching the guide means to the waist of the golfer comprises a clip formed on each end of the other side of the guide means.

8. The apparatus for assisting a golfer as claimed in claim 7 wherein the guide means further includes a cutaway region between the clips to conform the contour of that region of the guide means to the waist of the golfer.

9. Apparatus for assisting a golfer while putting comprising, in combination:

a semi-cylindrical extension adapted to be attached to a grip of a golf putter, the extension extending beyond a top end of the grip when attached thereto in a predetermined orientation and having a free end which terminates in a guide member with opposed guide surfaces, at least one of the guide surfaces being planar, the planar surface being aligned at right angles to a face of the putter when the extension is attached to the grip in the predetermined orientation; and a guide means with means for attachment to a waist of the golfer, the guide means including a slot for slidably accommodating the guide member, the slot being oriented in a horizontal plane when the guide means is attached to the waist of the golfer, to direct the putting stroke in a predetermined plane.

10. The apparatus for assisting a golfer while putting as claimed in claim 9 wherein the guide means is tubular.

11. The apparatus for assisting a golfer while putting as claimed in claim 10 wherein the means for attaching the guide means to the waist of the golfer comprises a clip formed at each end of the tubular guide means on a side opposite a side on which the slot is formed.

12. The apparatus for assisting a golfer while putting as claimed in claim 11 wherein an area between the clips is cut away in a curved contour to conform the area of the guide means between the clips to the shape of the golfer's waist.

13. Apparatus for assisting a golfer while putting comprising, in combination:

a golf putter having a head on one end and a grip on an opposite end, the grip being covered with a loop portion of a hook and loop fastener;

a semi-cylindrical extension attachable to the grip of the golf putter, the extension extending beyond a top end of the grip when attached thereto in a predetermined orientation and having a free end which terminates in a guide member with opposed guide surfaces, at least one of the guide surfaces being planar, the planar surface being aligned at right angles to a face of the putter when the extension is attached to the grip in the predetermined orientation, the extension including at least one strip of a hook portion of the hook and loop fastener adhered to a surface of the extension so that the hook portion of the fastener contacts and engages the loop portion on the putter grip when the extension is in the predetermined orientation; and a guide means for attachment to a waist of the golfer, the guide means including a slot for slidably accommodating the guide member, the slot being formed on a first side of the guide means and oriented in a horizontal plane when the guide means is attached to the waist of the golfer to direct the putting stroke in a predetermined plane, the guide means being a tubular body having a clip formed on each end of an other side thereof, an area between the clips being cut away in a curved contour to conform to the shape of the waist of the golfer.

14. The apparatus for assisting a golfer while putting as claimed in claim 13 wherein the guide member is formed by flattening a terminal end of the semi-cylindrical extension.

15. A kit for providing an apparatus to assist a golfer while putting comprising, in combination:

a semi-cylindrical extension adapted to be attached to a grip of a golf putter, the extension having a top end which terminates in a guide member with opposed guide surfaces, at least one of the guide surfaces being planar;

a guide means for attachment to a waist of the golfer, the guide means including a slot for slidably accommodating the guide member, the slot being oriented in a horizontal plane when the guide means is attached to the waist of the golfer; and a hook and loop fastener comprising a loop fastener having a backing side and a loop side, the backing side being adapted for attachment to a golf putter grip so that the putter grip is at least partially covered with the loop fastener and a hook fastener adapted for attachment to the semi-cylindrical extension so that the hooks engage the loops when the putter grip is pressed into a bight formed by the semi-cylindrical extension.

16. The kit as claimed in claim 15 wherein the kit further includes means for placing alignment marks on a front and rear surface of the putter grip to assist in properly orienting the semi-cylindrical extension on the putter grip.

* * * * *